US005582059A

United States Patent [19]

Schubert

[11] Patent Number: 5,582,059

[45] Date of Patent: Dec. 10, 1996

[54] FORGING MACHINE

[76] Inventor: Peter Schubert, 41564, Kaarst, Germany

[21] Appl. No.: 357,318

[22] Filed: Dec. 16, 1994

[30] Foreign Application Priority Data

Dec. 16, 1993 [DE] Germany ..... 43 42 924.6

[51] Int. Cl.[6] ..... B21J 7/14

[52] U.S. Cl. ..... 72/402; 72/441; 72/453.01

[58] Field of Search ..... 72/402, 399, 453.01, 72/446, 441, 455; 100/257

[56] References Cited

U.S. PATENT DOCUMENTS

| | | | |
|---|---|---|---|
| 364,142 | 5/1887 | Stiles | 72/446 |
| 3,318,235 | 5/1967 | Hanni | 72/441 |
| 3,822,456 | 7/1974 | Petruzzi | 72/446 |
| 4,377,084 | 3/1983 | Kaminski | 72/455 |
| 4,796,456 | 1/1989 | Schmoll et al. | 72/402 |
| 4,813,263 | 3/1989 | Schubert et al. | 72/402 |
| 4,831,864 | 5/1989 | Schmoll et al. | 72/402 |

FOREIGN PATENT DOCUMENTS

| | | | |
|---|---|---|---|
| 0228030 | 12/1986 | European Pat. Off. . | |
| 894201 | 10/1953 | Germany | 72/453.01 |
| 647286 | 10/1962 | Italy | 72/453.01 |

OTHER PUBLICATIONS

P. Metzger, "The numerically controlled radial forming machine . . . " vol. 55, Reports from Institute for Forming Tech., New York, 1980, pp. 36–39, 67–69, 112, 113, 129.

*Primary Examiner*—Daniel C. Crane

*Attorney, Agent, or Firm*—Jacobson, Price, Holman & Stern, PLLC

[57] ABSTRACT

The invention relates to forging machines which are provided with in particular four rams which are arranged offset at 90° to one another in a cruciform manner in one plane, act radially upon the workpiece, guided longitudinally in the system axis, and are equipped with tools. Piston-cylinder units provided for driving the rams are dimensioned for the entire stroke of the rams. The object of the invention is a simple, secure setting of the stroke-end position of the rams corresponding to the current tool setting or width. This object is attained in that the stroke of each ram (2) or the cylinder (4) connected to it can be limited in the inner stroke-end position by displaceable stops (17, 18, 19) arranged between the machine frame (1) and a projection (**14*b*) on the ram (2) or cylinder (4). It is particularly advantageous to use as the stops spacer members (18, 19) in the form of plates pivotable about an axis parallel to the ram axis and having eccentric extensions (24, 25) pivoting into and out of the path of the projection (14*b***).

10 Claims, 4 Drawing Sheets

FORGING MACHINE

BACKGROUND OF THE INVENTION

In order to forge workpieces with a distinct longitudinal axis, forging machines are used which have three or more rams arranged at different angles in one plane, and in particular four rams which are arranged offset at 90° to one another in a cruciform manner. The rams act radially upon the workpiece, which is guided longitudinally in the system axis, and are equipped with tools. It is structurally advantageous if the rams, which are guided in the machine frame, are constructed, at their ends remote from the tools (or dies), in the form of cylinders of piston-cylinder units open towards the outside, or are connected to such piston-cylinder units.

Because of the considerable forming capacity of these radial-forming forging machines, a high degree of enclosure, up to complete encirclement, of the workpiece has to be provided in the forming region. To this end, the tools should form a closed pass contour in the inner end position of the stroke, which position is adjustable. This is achieved in that either the tools are transversely displaceable in their common plane by means of tool supports on the rams and the part of the tool operating face exceeding the pass-contour dimension is covered by a lateral face of an adjacent tool, the tools being set accordingly by displacement devices acting upon the supports (U.S. Pat. Nos. 4796456, 4813263, and 4831864 corresponding to (EP 0228030 B1), or replaceable tools of suitable width are used (Peter Metzger, "*Die numerisch gesteuerte Radial-Umformmaschine und ihr Einsatz im Rahmen einer flexiblen Fertigung*" [The numerically controlled radial forming machine and its use in the framework of flexible finishing], Vol. 55 of Reports from the Institute for Forming Technology of the University of Stuttgart, published by Springer-Verlag, Berlin-Heidelberg-New York, 1980, pp. 36–39, 67–69, 112, 113, 129).

For a forging machine which is to be used for open-die fine forging it is recommended that the piston-cylinder units should be dimensioned in accordance with the operating stroke of the ram in order to minimise the compression volume, this being an essential pre-condition for rapid-stroke operation. The stroke position, by which the pass contour bounded by the tools is determined, can be set by adjustment of crossheads which are displaceable on the machine frame and support the pistons of the piston-cylinder units.

SUMMARY OF THE INVENTION

The invention relates to a forging machine which is to be used primarily for open-die elongation forging, i.e. is operated with a relatively small number of strokes per min but a great depth of penetration. In the case of a forging machine of this type, the piston-cylinder units can be dimensioned for executing the entire stroke of the rams, so that stationary crossheads can be provided for supporting the pistons. The object of the invention is to provide a simple, secure fixation of the stroke-end position corresponding to the respective tool setting or pass width. This object is attained in that in a forging machine, of which the rams, guided in the machine frame, are constructed at their ends remote from the tools in the form of cylinders of piston-cylinder units open towards the outside or are connected to such cylinders, according to the invention the stroke of each ram or of the cylinder connected thereto can be limited in the stroke-end position by one or more displaceable stops arranged between the machine frame and a projection on the ram or cylinder.

In one embodiment of the invention, threaded spindles projecting from the machine frame act as said stops, the threaded spindles being supported in the frame by threaded nuts and being provided with drives for the relative rotation of the threaded spindles and threaded nuts, which permits a continuous adjustment of the stroke-end position.

In many cases and in particular in open-die elongation forging, however, it is sufficient to adjust the stroke-end position in steps. A further embodiment of the invention therefore provides spacer members which can be moved into and out of the region of the projection of the rams and define respective stop positions of the rams relative to the machine frame. In further development of this embodiment, the spacer members are plates each pivotable about an axis parallel to the ram axis and having eccentric extensions which can pivot into and out of the region of the projection. It is particularly advantageous to arrange the said stop-forming spacer members so as to be alternatively pivotable about two axes and to dimension the eccentric extensions thereof in such a way that they mutually overlap even when pivoted outside the projection region.

BRIEF DESCRIPTION OF THE DRAWINGS

Embodiments of forging machines according to the invention are illustrated in the drawings, in which.

Figure 1:
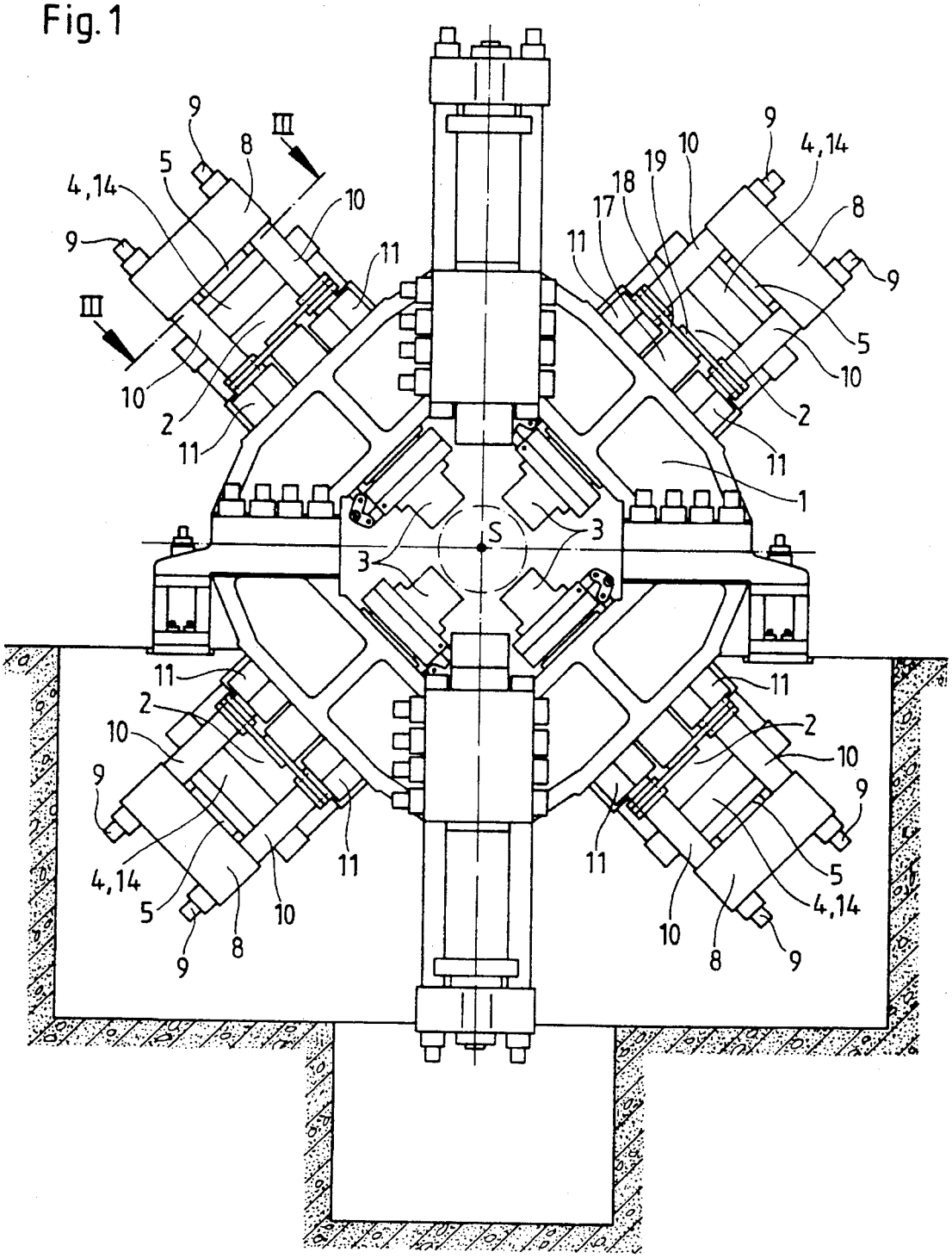
FIG. 1 is a front elevation of a forging machine viewed in the direction of the system axis S.

The forging machine comprises a frame 1 which guides four rams 2 in a plane at right angles to the system axis S, the rams 2 being arranged offset at 90° to one another in a cruciform manner in the common working plane and being movable radially to the system axis S. The rams 2 are equipped with tools 3 at their ends facing the system axis S. At their ends remote from the system axis S the rams 2 are constructed in the form of cylinders 4 open towards the outside, i.e. are provided with a cylinder bore **4*b*, it being possible for the parts of the rams 2 which form the cylinders 4 to form separate parts connected to the rams 2** in a releasable manner.

Plunger pistons 5 with stuffing boxes 6 and seals 7 are inserted in the cylinders 4. The pistons 5 are supported on crossheads 8 which are connected by the rods 9 to the frame 1 with the interposition of support blocks 11 and pressure columns 10 with pre-stressing. Pressure medium can be supplied or removed by way of the bores 12 in the crossheads 8 and by way of the bores 13 in the pistons 5. The cylinders 4 are provided with flanges 14 each provided with two projections **14*a*. The rams 2 with the tools 3 are caused to return by pistons of piston-cylinder units, the cylinders 15 of which are supported on the frame 1 and act with the pistons 16 upon the projections 14*a* and thus upon the cylinders 4 and the rams 2**.

The tools 3 of radial-forming forging machines move inwards simultaneously in a common working plane, and for this reason care has to be taken to prevent the tools from colliding. Depending upon the width of the tools of the replaceable sets of tools used or, as in the present embodiment, depending upon the setting of the tools 3 displaceable transversely to the rams 2 in the operating plane, the strokes of the rams have to be limited in such a way that in the inner end positions of their strokes the tools 3 form a substantially closed pass contour without touching one another. This limitation of the strokes can be performed by controlling the ram actuation. According to the invention it is provided that the stroke limitation is provided additionally or solely by displaceable stops.

In the embodiment according to FIGS. 1 to 4, stop brackets 17, which are situated in the stroke path of projection 14*b* of the flanges 14 of the cylinders 4 connected to the rams 2, are secured to the frame 1 on both sides of each ram 2. For a ram 2 with a tool 3 the associated stop brackets 17 fix the stroke-end position in which the ram 2 with the tool 3 comes closest to the system axis S, as the projections 14*b* abut on the stop brackets 17. Other inner end positions of the stroke of the ram 2 and tool 3, which are at a greater distance from the system axis S, can be set by spacer plates 18 and 19, one or both of which can be pivoted into the stroke path of the projections 14*b* between the latter and the brackets 17. For this purpose the spacer plates 18 and 19 are provided with bores 20, are set upon the round columns 10 and are held pivotably by setting rings 21 on the columns 10. The spacer plates 18 and 19 are pivoted by piston-cylinder units 22 which are supported by brackets 23 secured to the frame 1 and are connected to the spacer plates 18 and 19. The spacer plates 18 and 19 have parts 24 and 25 arranged eccentrically to the respective pivot axis passing through the middle of the respective bore 20, which are shaped and dimensioned in such a way that when pivoted out they are situated outside the stroke path of the projections 14*b*, but they continue to overlap one another and the stop brackets 17, so to ensure that they can be pivoted at all times.

Figure 2:
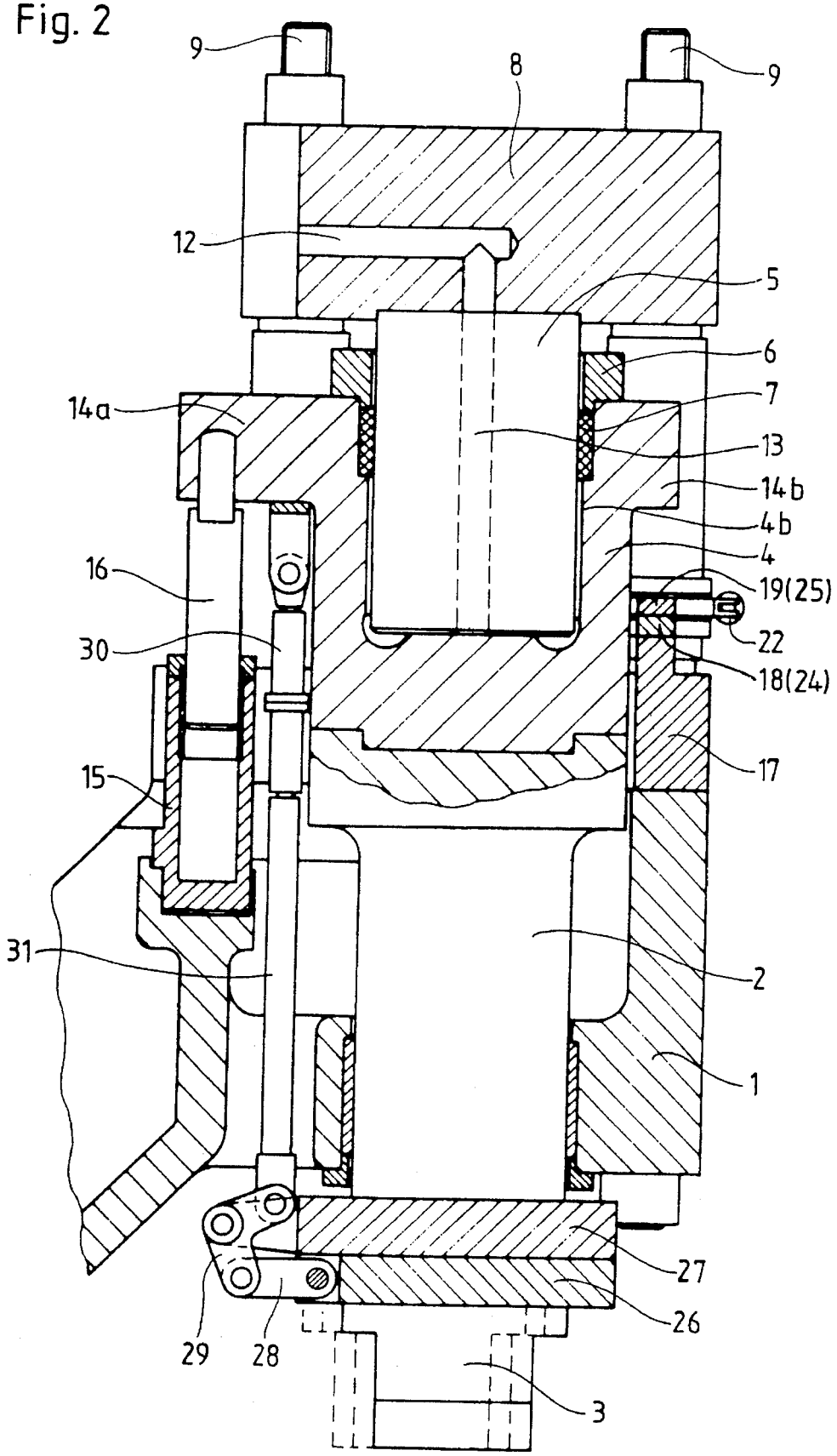
FIG. 2 is a detailed view on an enlarged scale in radial section along line II—II indicated in FIG. 3.
Figure 3:
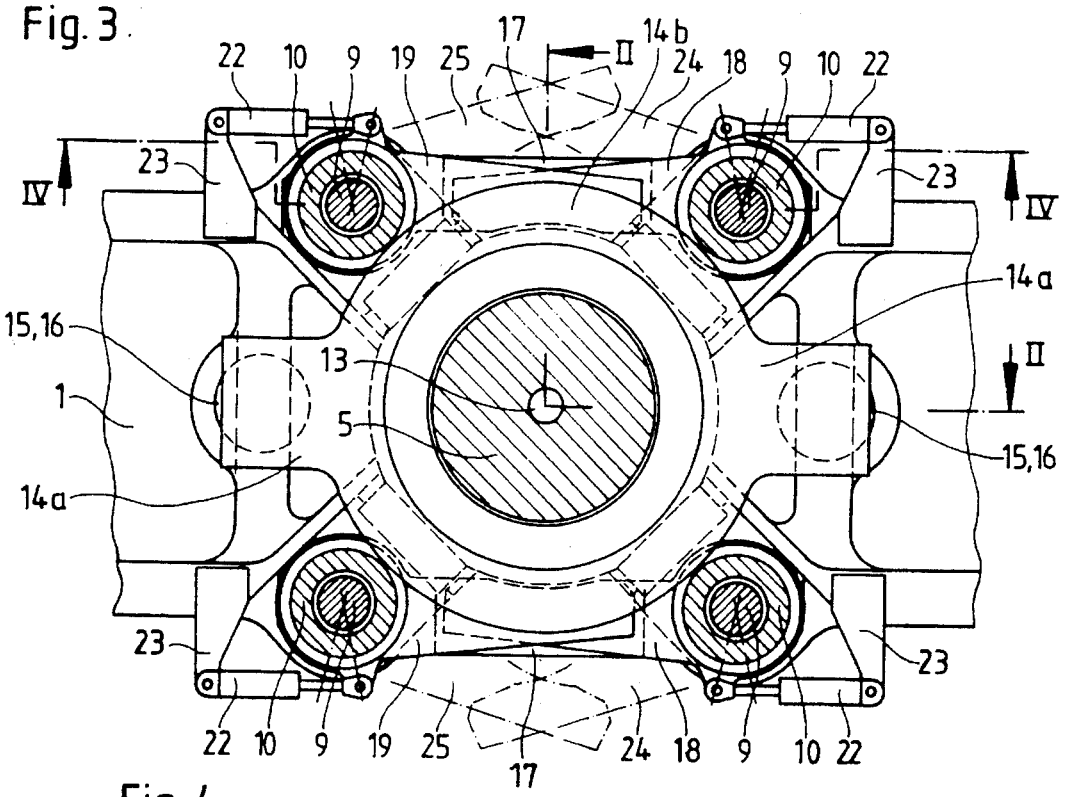
FIG. 3 is a section along the section line III—III indicated in FIG. 1.
Figure 4:
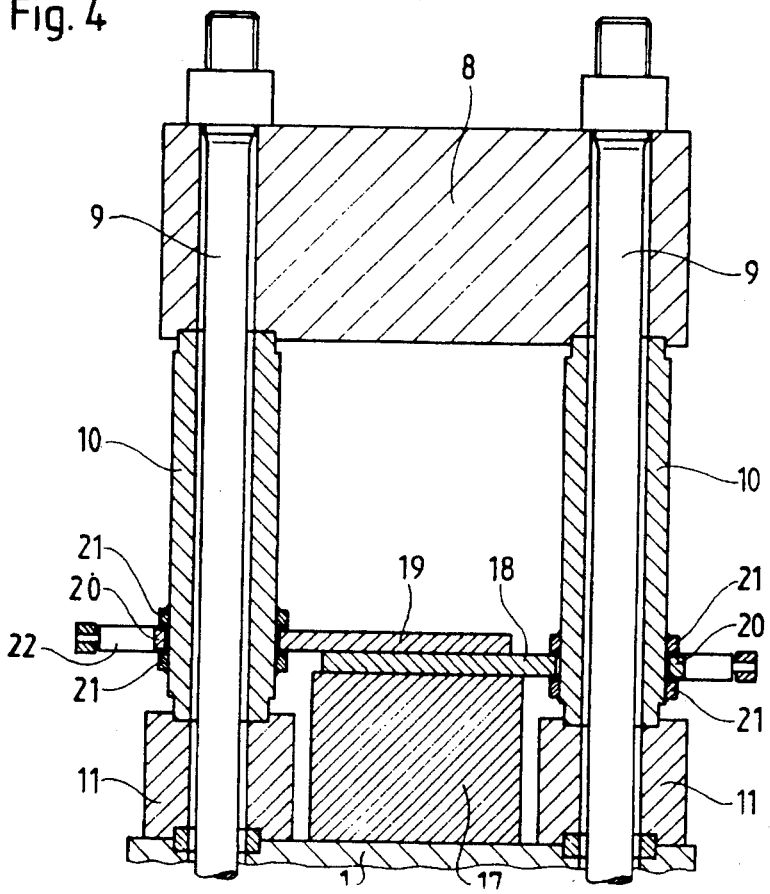
FIG. 4 is a section along the section line IV—IV indicated in FIG. 3.

In the embodiment according to FIGS. 1 to 4, two spacer plates 18 and 19 are provided on both sides of each ram 2 in co-operation with a respective stop bracket 17, so as to produce three defined stroke-end positions for the ram 2. It is also of course possible for more than two spacer plates to be provided, in which case an additional stroke-end position can be defined with every additional spacer plate and a finer gradation can be provided between the stroke-end positions. Corresponding to the three stroke-end positions of the rams 2, the tools 3 can be displaced transversely into three positions in the operating plane. FIG. 2 shows a first position of the tool 3, and the two further positions are indicated in broken lines. The tool 3 is secured to a support 26. The said support 26 is guided on a front plate 27 connected to the ram 2. The support 26 is releasably connected to the front plate 27 in a known manner by clamping members (not shown). After the release of the clamping connection the support 26 can be displaced along the front plate 27 by a two-stage piston-cylinder unit 30 through a push rod 31 by way of a link bar 28 and an angle lever 29 mounted on the front plate 27. The piston-cylinder unit 30 is supported on the flange 14 of the cylinder 4.

Figure 5:
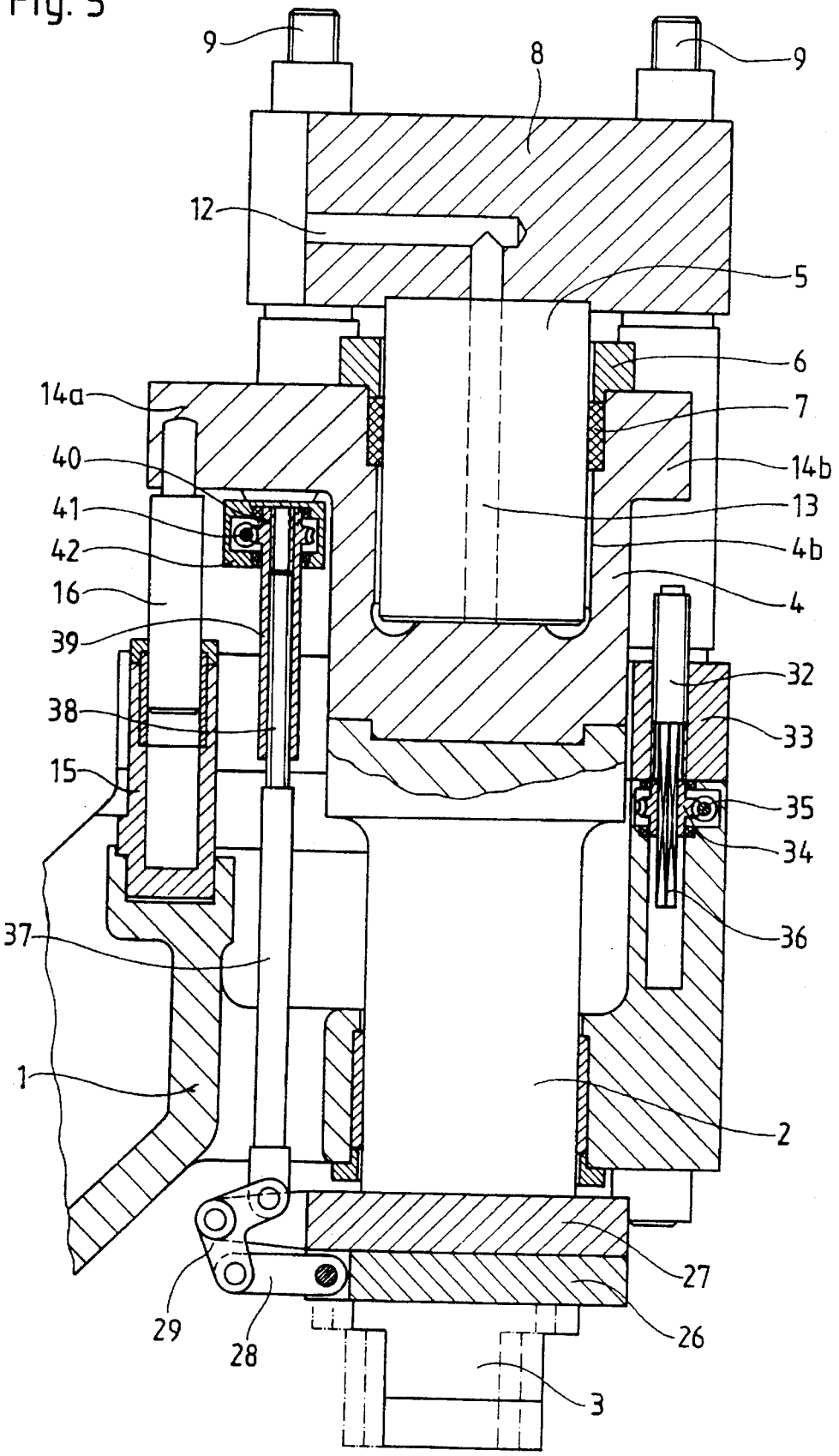
FIG. 5 shows a modified embodiment in a section corresponding to the section shows in FIG. 2.

The embodiment illustrated in FIG. 5 corresponds to the embodiment illustrated in FIGS. 1 to 4 except for the design of the stops for limiting the stroke and the design of the actuating drive for the transverse displacement of the tool. In the case of the embodiment according to FIG. 5, the stop positions are continuously variable. A threaded spindle 32 is provided as the stop for limiting the stroke, the threaded spindle 32 being rotatable with its threaded shaft in a nut member 33 secured to the frame 1. The spindle is rotated by a worm wheel 34 with a worm 35 and a motor (not shown). The worm wheel 34 with its worm 35 is mounted in the frame 1. The threaded spindle 32 engages with a square shaft 36 in a corresponding bore in the worm wheel 34. Corresponding to the continuous displacement of the stroke-limiting stop spindle 32, in this embodiment according to FIG. 5 the transverse displacement of the tool is also provided by an actuating drive operating in a continuous manner. To this end, the rod 37 is provided with a threaded shaft 38 which engages in a threaded sleeve 39. The threaded sleeve 38 is provided with a worm-wheel rim 40 and is mounted with an associated drive worm 41 and a drive motor (not shown) in a housing 42, supported on the flange 14*a* of the cylinder 14 forming part of the ram 2. The angle lever 29 is pivoted by the rotation of the threaded sleeve 39 by way of the threaded shaft 38 and the rod 37, and the tool 3 is set between the positions indicated in FIG. 5 in accordance with the setting of the stops for limiting the stroke (threaded spindles 32).

Features of the forging machine disclosed herein are further disclosed in co-pending applications Ser. Nos. 08/357,332 and 08/358,010 of even date herewith entitled "Forging Machine" which are hereby incorporated herein by reference.

I claim:

1. A forging machine comprising a machine frame having a system axis extending therethrough; a plurality of forging rams, each adapted to carry, in use, a die having a working surface facing the system axis, each ram having a ram axis and being supported and guided by the machine frame for movement along said ram axis radially towards and away from the system axis over a working stroke, with the rams disposed at respective angles to one another within a common working plane transverse to the system axis, each ram having a radially inner end; respective radial pressure fluid piston and cylinder units acting between said rams and the machine frame for effecting said working stroke and each comprising a respective cylinder in driving relation with said ram, said cylinder having an open outer end directed away from said system axis, and a static piston slidably located in said cylinder; a respective crosshead supporting each said piston and supported on said machine frame; and means for setting the radially innermost end position of the ram in said working stroke, comprising abutment means on one of said ram and said cylinder, and selectively placeable and adjustable stop means arranged and adapted to be disposed selectively in the path of movement of said abutment means for thereby limiting said stroke or removed from said path for permitting passage of said abutment means.

2. The forging machine of claim 1, further comprising a tool support mounted at the said radially inner end of each said ram and adapted for adjustment of a tool carried thereby in use, in a direction transverse relative to the radial direction of the ram and within the said common plane, whereby the tool support can be adjustably offset from the said ram axis within the working plane in dependence on the set ram innermost end position, such that tools held by the tool supports in use can be arranged with parts of their working surfaces overlapping side surfaces of adjacent tools to form at the said innermost end positions a closed forging pass contour smaller than the working surfaces of the tools; and actuator means for moving each said tool support in said transverse direction.

3. A forging machine with four rams which are arranged in a cruciform manner in one plane, are offset at 90° to one another, act radially upon the workpiece guided longitudinally in the system axis and are equipped with tools, wherein the rams guided in the machine frame form cylinders open towards the outside from the system axis or are connected to such cylinders and are adjustable in their respective stroke-end position by displacement means, and wherein, as a function of the setting of the end position of the stroke of the rams, either the tools transversely displaceable in their common plane by means of tool supports on the rams and covered with the part of their operating face exceeding the pass-contour dimension by a lateral face of an adjacent tool can be set by displacement devices acting upon the supports in such a way, or replaceable tools of such a width are used, that the tools form a closed pass contour in their respective stroke-end positions, the stroke of each ram or of the cylinder connected thereto being limitable in the stroke-end position by displaceable and adjustable stops arranged between the machine frame and a projection on the ram or cylinder.

4. A forging machine according to claim 1, wherein said stops are threaded spindles projecting from the machine frame, the threaded spindles being supported in the machine frame by threaded nuts and drives being provided for effecting relative rotation of said threaded spindles and threaded nuts, for thereby axially moving said spindles.

5. A forging machine according to claim 1, wherein said stops comprise at least one spacer member arranged to be moved into and out of the path of motion of said projection and which define the stop position.

6. A forging machine according to claim 5, wherein said spacer member is a plate pivotable about an axis parallel to the ram axis and having an eccentric extension which on pivoting of said plate is moved into and out of the projection path.

7. A forging machine comprising a machine frame having a system axis extending therethrough;

a plurality of forging rams, each adapted to carry, in use, a die having a working surface facing the system axis, each ram having a ram axis and being supported and guided by the machine frame for movement along said ram axis radially towards and away from the system axis over a working stroke, with the rams disposed at respective angles to one another within a common working plane transverse to the system axis, each ram having a radially inner end;

respective radial pressure fluid piston and cylinder units acting between said rams and the machine frame for effecting said working stroke and each comprising a respective cylinder in driving relation with said ram, said cylinder having an open outer end directed away from said system axis, and a static piston slidably located in said cylinder;

a respective crosshead supporting each said piston and supported on said machine frame; and means for setting the radially innermost end position of the ram in said working stroke, comprising abutment means on one of said ram and said cylinder, and selectively placeable stop means arranged and adapted to be disposed selectively in the path of movement of said abutment means for thereby limiting said stroke or removed from said path for permitting passage of said abutment means, said stop means including at least one spacer member arranged to be moved into and out of the path of motion of said projection and which define the stop position, said spacer member being a plate pivotable about an axis parallel to the ram axis and having an eccentric extension which on pivoting of said plate is moved into and out of the projection path, the forging machine having, for each said ram, a plurality of said stop-forming spacer member plates each pivotable about a respective said axis, the respective said extensions of said plates being so dimensioned that said extensions overlap one another when pivoted to positions thereof outside of the path of movement of said projection.

8. The forging machine of claim 7 having two said spacer member plates for each said ram.

9. A forging machine comprising a machine frame having a system axis extending therethrough; a plurality of forging rams, each adapted to carry, in use, a die having a working surface facing the system axis, each ram having a ram axis and being supported and guided by the machine frame for movement along said ram axis radially towards and away from the system axis over a working stroke, with the rams disposed at respective angles to one another within a common working plane transverse to the system axis, each ram having a radially inner end; respective radial pressure fluid piston and cylinder units acting between said rams and the machine frame for effecting said working stroke and each comprising a respective cylinder in driving relation with said ram, said cylinder having an open outer end directed away from said system axis, and a static piston slidably located in said cylinder; a respective crosshead supporting each said piston and supported on said machine frame; and means for setting the radially innermost end position of the ram in said working stroke, comprising abutment means on one of said ram and said cylinder, and selectively placeable stop means arranged and adapted to be disposed selectively in the path of movement of said abutment means for thereby limiting said stroke or removed from said path for permitting passage of said abutment means;

fixed stop means in the path of said abutment means between said displaceable stop means and said system axis for defining a radially innermost end position of the ram stroke when said displaceable stop means are removed from said path.

10. The forging machine of claim 9, wherein said fixed stop means provides a supporting abutment for said displaceable stop means against impact forces on the latter when disposed in said path of movement.

* * * * *